US009951931B1

(12) United States Patent
Lan

(10) Patent No.: US 9,951,931 B1
(45) Date of Patent: Apr. 24, 2018

(54) LED LAMP

(71) Applicant: Shenzhen Guanke Technologies Co., Ltd., Shenzhen (CN)

(72) Inventor: Qing Lan, Shenzhen (CN)

(73) Assignee: Shenzhen Guanke Technologies Co., Ltd., Shenzhen (CN)

( * ) Notice: Subject to any disclaimer, the term of this patent is extended or adjusted under 35 U.S.C. 154(b) by 78 days.

(21) Appl. No.: 15/291,243

(22) Filed: Oct. 12, 2016

(51) Int. Cl.

| | |
|---|---|
| ***F21V 17/02*** | (2006.01) |
| ***F21V 29/76*** | (2015.01) |
| ***F21V 23/02*** | (2006.01) |
| ***F21V 19/00*** | (2006.01) |
| ***F21V 17/00*** | (2006.01) |
| *F21Y 115/10* | (2016.01) |

(52) U.S. Cl.
CPC ..... *F21V 17/02* (2013.01); *F21V 17/007* (2013.01); *F21V 19/006* (2013.01); *F21V 23/02* (2013.01); *F21V 29/76* (2015.01); *F21Y 2115/10* (2016.08)

(58) Field of Classification Search
CPC ..... F21V 17/02; F21V 29/76; F21V 23/02; F21V 19/006; F21V 17/007; F21Y 2115/10
See application file for complete search history.

(56) References Cited

U.S. PATENT DOCUMENTS

| | | | | |
|---|---|---|---|---|
| 2008/0062689 | A1* | 3/2008 | Villard | F21V 14/02 362/249.07 |
| 2012/0033425 | A1* | 2/2012 | Lee | F21V 19/00 362/249.02 |
| 2015/0009689 | A1* | 1/2015 | Chen | F21K 9/20 362/382 |
| 2016/0061423 | A1* | 3/2016 | Fong | F21K 9/23 362/363 |

* cited by examiner

*Primary Examiner* — Ali Alavi

(57) ABSTRACT

A LED lamp includes a lamp head and a lamp body mounted to the lamp head. The lamp body includes a first main body and two second main bodies. The first main body includes a first upper cover, a first lower cover, a first elastic element, and a second elastic element. Each of the second main bodies includes a second upper cover, a second lower cover. The first elastic element is mounted between the first upper cover and the second upper cover, and the second elastic element is mounted between the first lower cover and the second lower cover. When the LED lamp is in an open state, the second main bodies relative to the first main body are unfolded; when the LED lamp is in a closed state, the second main bodies relative to the first main body are folded.

20 Claims, 14 Drawing Sheets

LED LAMP

BACKGROUND

1. Technical Field

The present disclosure generally relates to a LED (light-emitting diode) lamp.

2. Description of Related Art

A LED lamp generates a lot of heat when the LED lamp is on, and the LED lamp often includes a heat sink to dissipate heat. When the LED lamp takes place a high power lamp, the LED lamp must have a heat sink having a large radiating area. However, a convention LED lamp having the high power cannot be folded or unfolded, resulting in inconvenience for packaging and transportation of the LED lamp having the high power.

SUMMARY

The disclosure relates to a LED lamp.

In one aspect, a LED lamp includes a lamp head and a lamp body mounted to the lamp head. The lamp body includes a first main body and a pair of second main bodies positioned two sides of the first main body. The first main body includes a first upper cover, a first lower cover, at least one first elastic element, and at least one second elastic element. Each of the second main bodies is rotationally mounted to the first main body and includes a second upper cover, a second lower cover. One end of the first elastic element is mounted to the first upper cover, another end of the first elastic element is mounted to the second upper cover, one end of the second elastic element is mounted to the first lower cover, another end of the second elastic element is mounted to the second lower cover. When the LED lamp is in an open state, the first elastic element and the second elastic element is in a free state, each of the second main bodies relative to the first main body is unfolded; when the LED lamp is in a closed state, the first elastic element and the second elastic element is in a compression state, each of the second main bodies relative to the first main body is folded.

Wherein the first upper cover includes a first fixing post, the second upper cover includes a second fixing post, the one end of the first elastic element is mounted to the first fixing post, the another end of the first elastic element is mounted to the second fixing post.

Wherein the first lower cover includes a third fixing post, the second lower cover includes a fourth fixing post, the one end of the second elastic element is mounted to the third fixing post, the another end of the second elastic element is mounted to the fourth fixing post.

Wherein the first upper cover defines a pair of first sliding grooves, each of the second upper coves comprises a first sliding post, wherein each of the first sliding posts slides along each of the first sliding grooves.

The first lower cover defines a pair of second sliding grooves, each of the second lower coves includes a second sliding post, wherein each of the second sliding posts slides along each of the second sliding grooves.

The first main body includes a first lighting device, a power device, and a first heat sink positioned between the first lighting device and the power device, the first heat sink, the first lighting device, and the power device are positioned between the first upper cover and the first lower cover.

Each of the second main bodies includes a second heat sink and a second lighting device, the second heat sink and the second lighting device are positioned between the second upper cover and the second lower cover, wherein when the LED lamp is the open state, each of the second heat sink relative to the first heat sink is unfolded; when the LED lamp is in the closed state, each of the second heat sink relative to the first heat sink is folded.

The lamp head includes a head housing and a rotating member, and a rotation range of the rotating member relative to the head housing is 0 degree to 350 degree.

The rotating member includes a first rotating portion and a second rotating portion, the first rotating portion includes a plurality of first protruding ribs, the second rotating portion includes a plurality of second protruding ribs, wherein when the first rotating portion rotates relative to the second rotating portion, the second protruding ribs move among the first protruding ribs.

The second rotating portion includes a plurality of cantilevers, one second protruding rib projects from each of the cantilevers, wherein a first slot is defined between two adjacent first protruding ribs, and each of the second protruding ribs is received in a corresponding first slot to position the first rotating portion and the second rotating portion.

The head housing includes a first block, the first rotating portion includes a second block together with the first block to prevent the lamp head from excessive rotation.

In another aspect, a LED lamp includes a lamp body and a lamp head mounted to the lamp body. The lamp body includes a first main body and a pair of second main bodies rotationally mounted to the first main body. The lamp head includes a head housing and a rotating member rotating relative to the head housing. The rotating member includes a first rotating portion and a second rotating portion, wherein the first rotating portion includes a plurality of first protruding ribs, the second rotating portion includes a plurality of second protruding ribs, wherein when the first rotating portion rotates relative to the second rotating portion, the second protruding ribs move among the first protruding ribs. When the LED lamp is in an open state, each of the second main bodies relative to the first main body is unfolded; when the LED lamp is in a closed state, each of the second main bodies relative to the first main body is folded.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
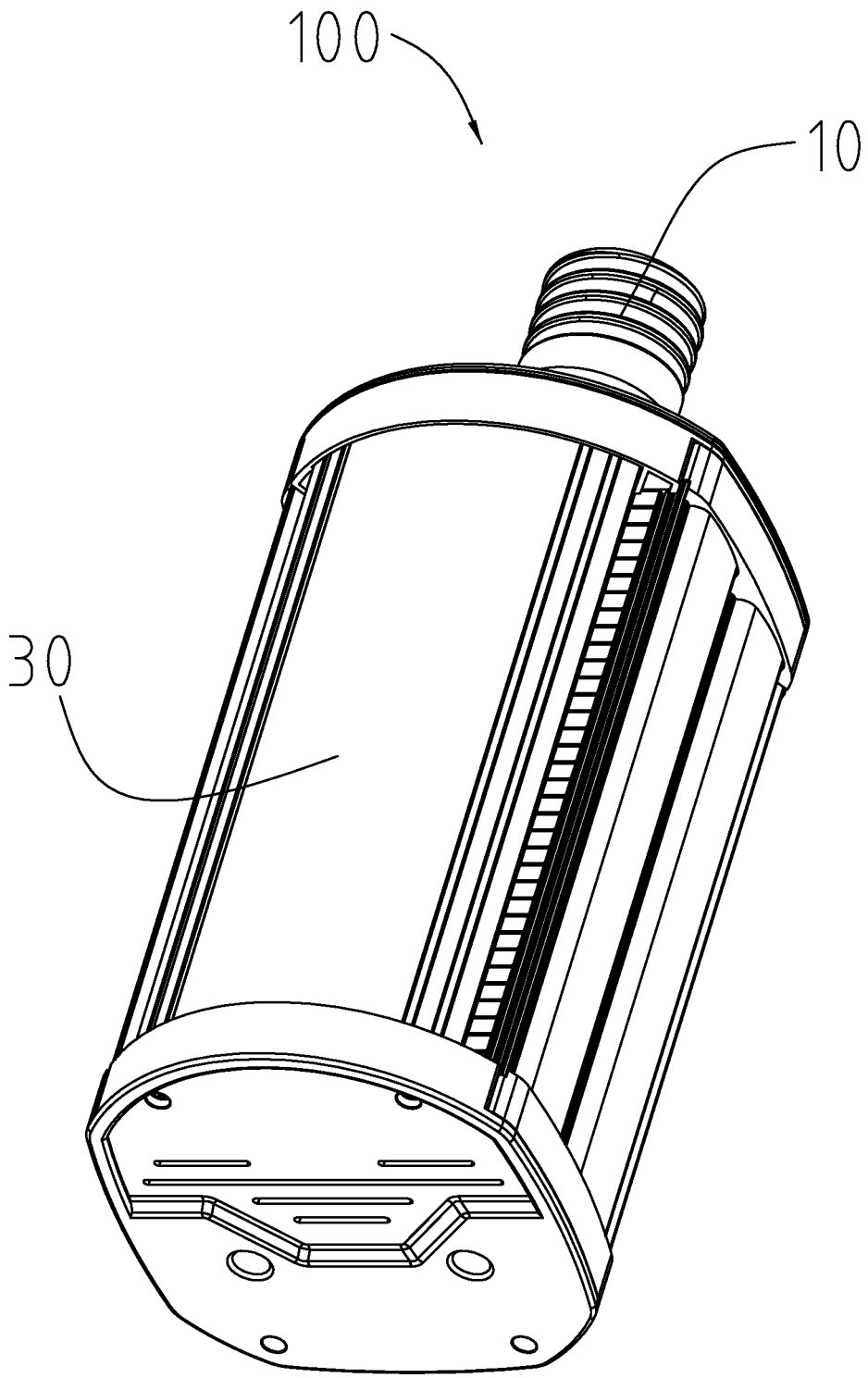
FIG. 1 is an assembled perspective view of a LED lamp in accordance with the present invention, showing the LED lamp in a closed state.

The disclosure is illustrated by way of example and not by way of limitation in the figures of the accompanying drawings, in which like reference numerals indicate similar elements. The embodiments described in accordance with the drawings are only examples, and thus the claimed invention is not limited thereto.

Referring to FIG. 1, the LED lamp 100 of the present invention includes a lamp head 10 and a lamp body 30.

Referring to FIG. 1 to FIG. 5, lamp body 30 is mounted to the lamp head 10, and includes a first main body 40 and a pair of second main bodies 60 positioned two sides of the first main body 40. The first main body 40 includes a first upper cover 41, a first lower cover 42, at least one first elastic element 43, and at least one second elastic element 44. Each of the second main bodies 60 is rotationally mounted to the first main body 40, and includes a second upper cover 61, a second lower cover 62. One end of the first elastic element 43 is mounted to the first upper cover 41, another end of the first elastic element 43 is mounted to the second upper cover 61. One end of the second elastic element 44 is mounted to the first lower cover 42, another end of the second elastic element 44 is mounted to the second lower cover 62. When the LED lamp 100 is in an open state, the first elastic element 43 and the second elastic element 44 is in a free state, each of the second main bodies 60 relative to the first main body 40 is unfolded; when the LED lamp 100 is in a closed state, the first elastic element 43 and the second elastic element 44 is in a compression state, each of the second main bodies 60 relative to the first main body 40 is folded.

Figure 2:
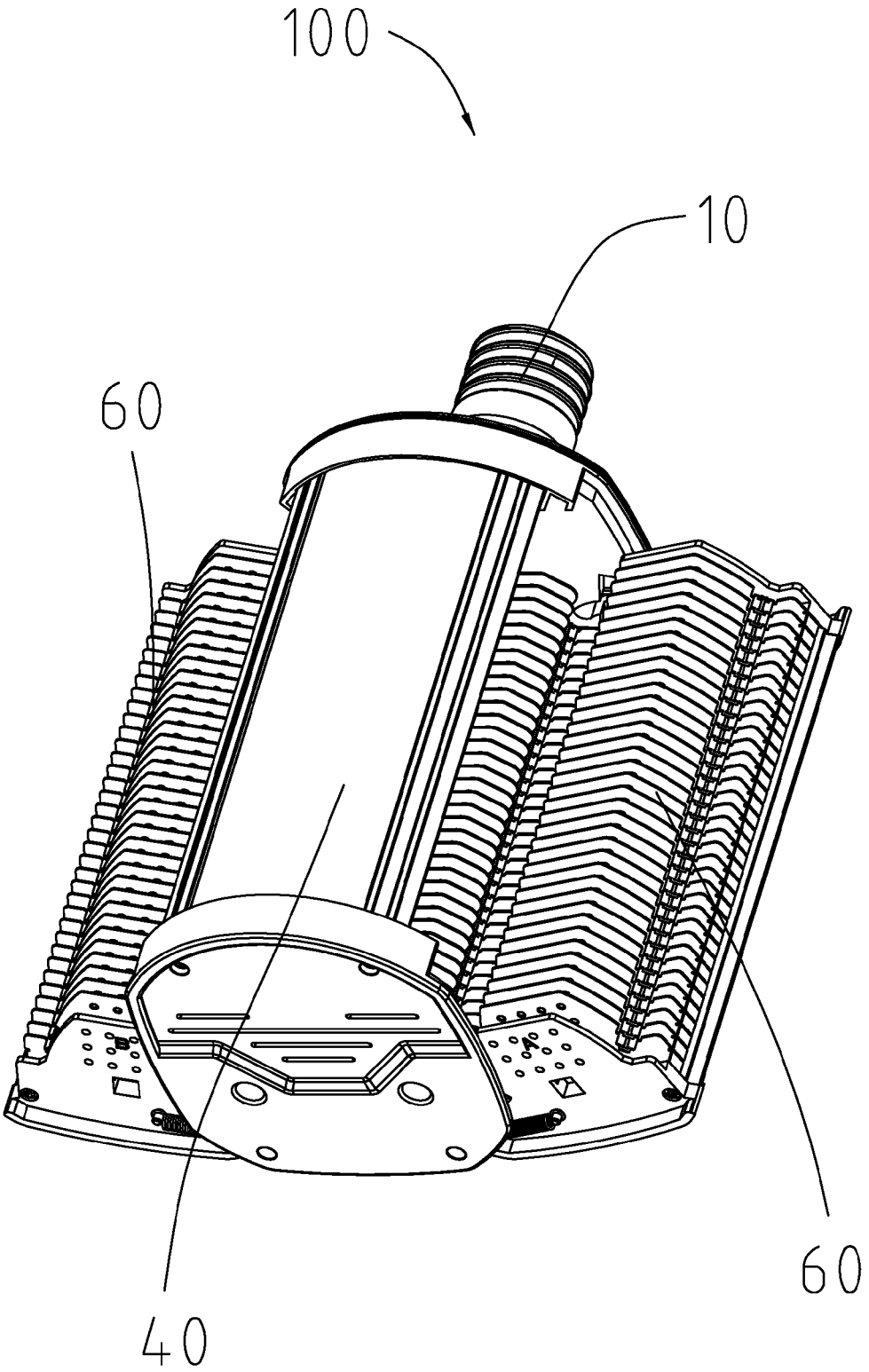
FIG. 2 is similar to FIG. 1, but showing the LED lamp in an open state.

In use, each of the second main bodies 60 rotates relative to the first main body 40, so that each of the second main bodies 60 relative to the first main body 40 is unfolded to provide lighting for users, thereby enlarging a illumination range of the LED lamp 100 and improving the utilization rate of light of the LED lamp 100, herein the LED lamp 100 is in the open state (referring to FIG. 2). In packaging and transportation, each of the second main bodies 60 rotates relative to the first main body 40, so that each of the second main bodies 60 relative to the first main body 40 is folded, herein the LED lamp 100 is in the closed state (referring to FIG. 1). That is to say, when the LED lamp 100 is on, the LED lamp 100 is in the open state to provide better lighting; in packaging and transportation, the LED lamp 100 is in the close state to reduce a volume of the LED lamp 100 to facilitate the transportation and packaging, thereby saving cost of transportation and packaging.

Figure 3:
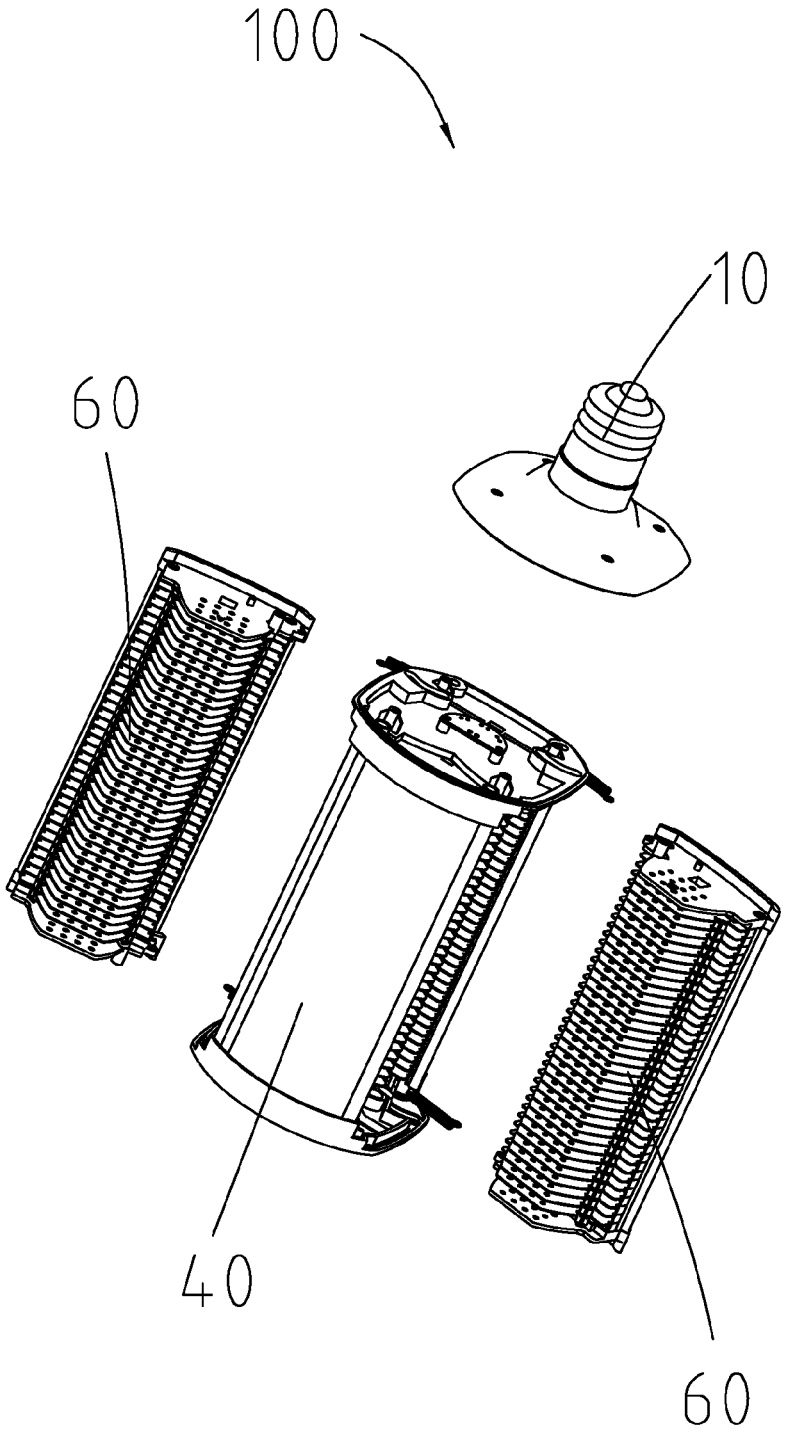
FIG. 3 is an exploded view of the LED lamp of FIG. 1.
Figure 4:
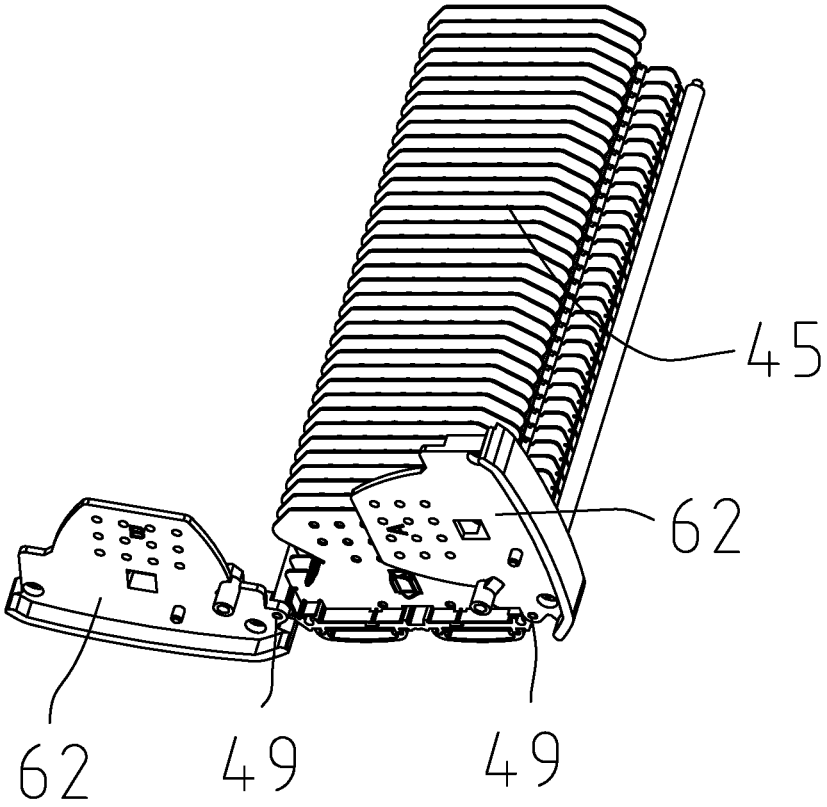
FIG. 4 is an assembled view of a part of the LED lamp of FIG. 2.
Figure 6:
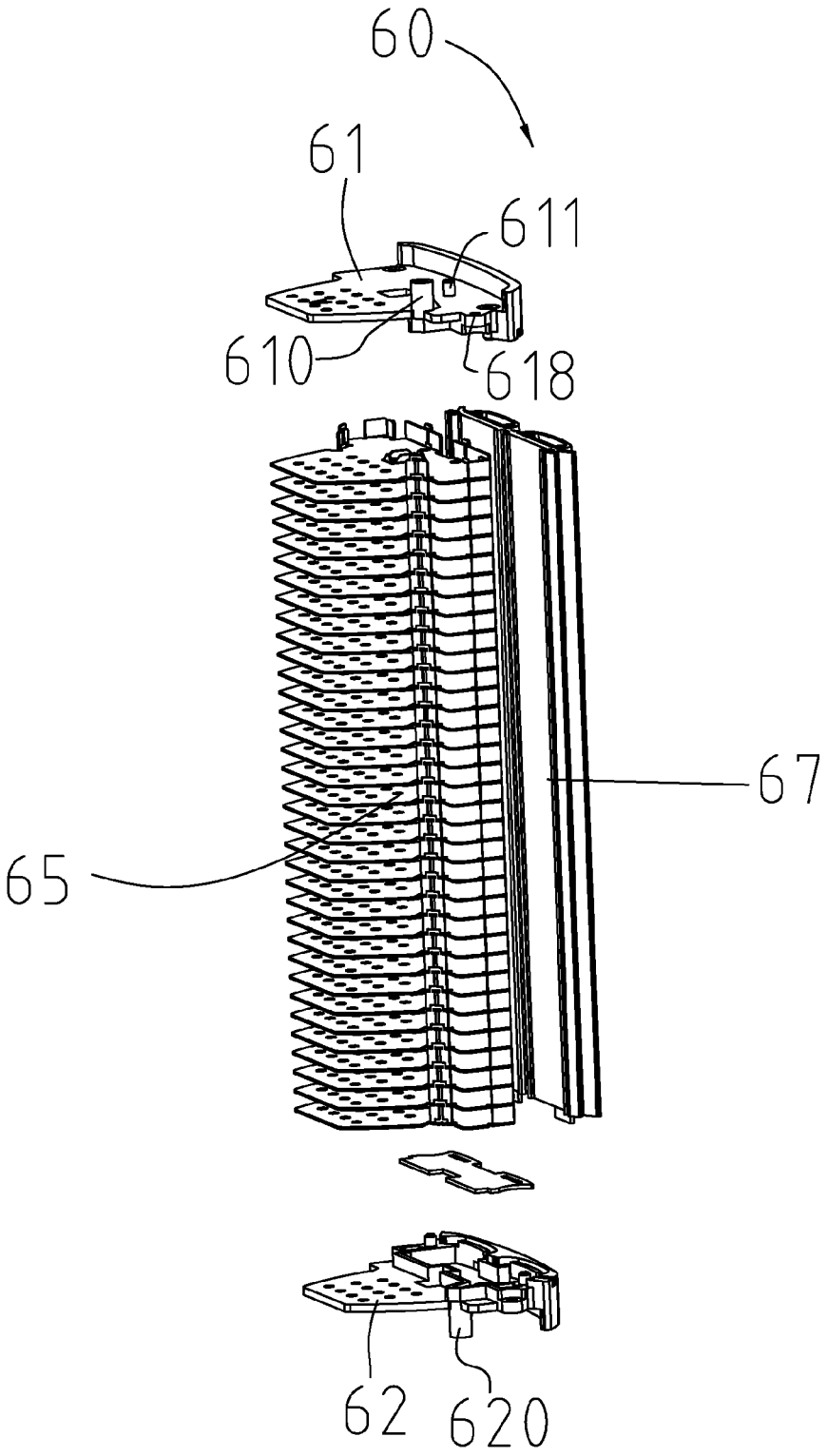
FIG. 6 is an exploded view of a second main body of the LED lamp of FIG. 1.

Referring to FIG. 3, FIG. 4, and FIG. 6, the first upper cover 41 includes a first fixing post 411. The second upper cover 61 includes a second fixing post 611. One end of the first elastic element 43 is mounted to the first fixing post 411, another end of the first elastic element 43 is mounted to the second fixing post 611.

Referring to FIG. 3, FIG. 4, FIG. 7, and FIG. 8, the first lower cover 42 includes a third fixing post 421, the second lower cover 62 includes a fourth fixing post 621. One end of the second elastic element 44 is mounted to the third fixing post 421, another end of the second elastic element 44 is mounted to the fourth fixing post 621.

In one embodiment, the first elastic element 43 and the second elastic element 44 is spring, and a structure of the first elastic element 43 is the same as a structure of the second elastic element 44. In another embodiment, the structure of the first elastic element 43 is different from the structure of the second elastic element 44.

Figure 5:
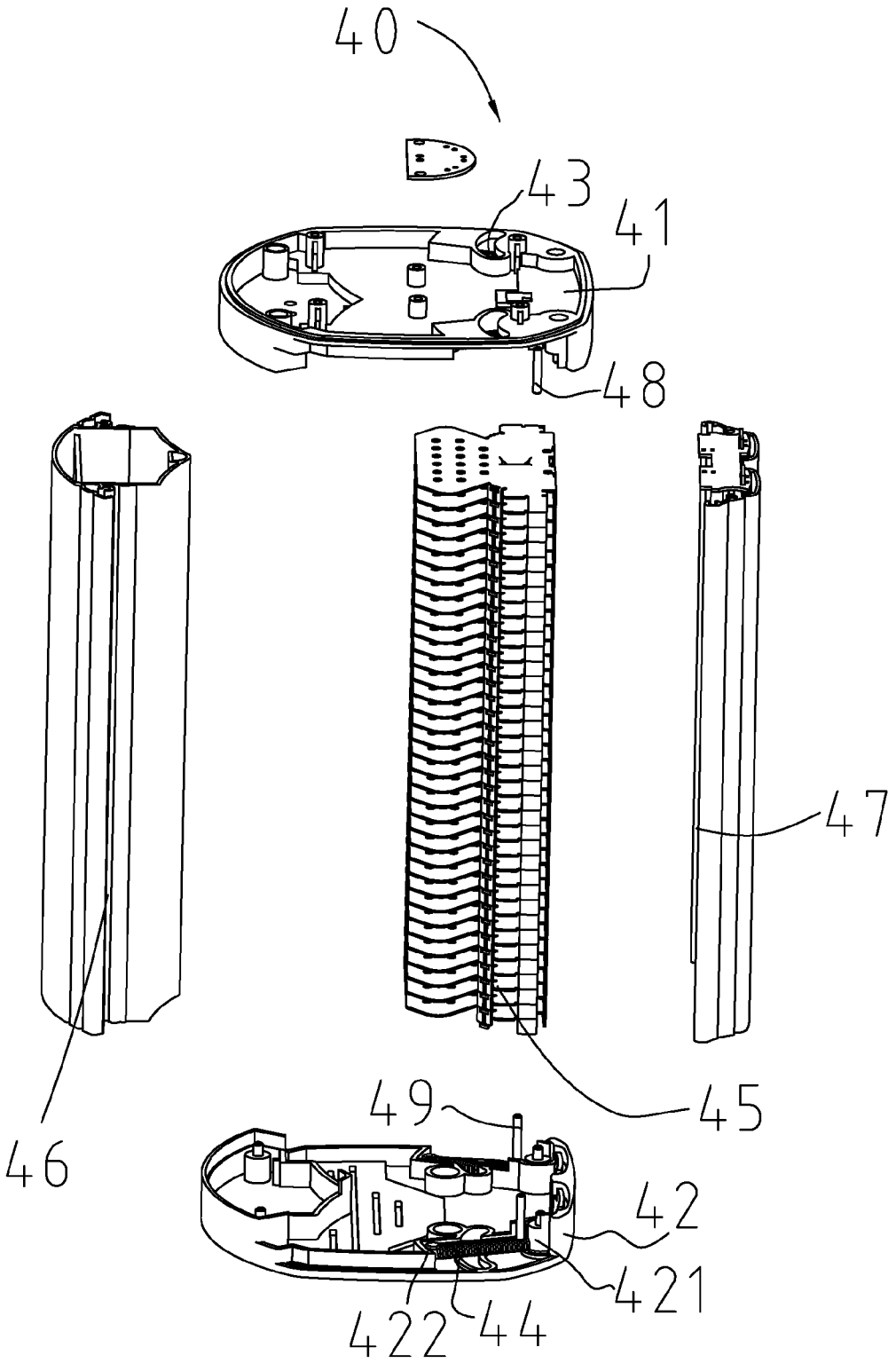
FIG. 5 is an exploded view of a first main body of the LED lamp of FIG. 1.
Figure 7:
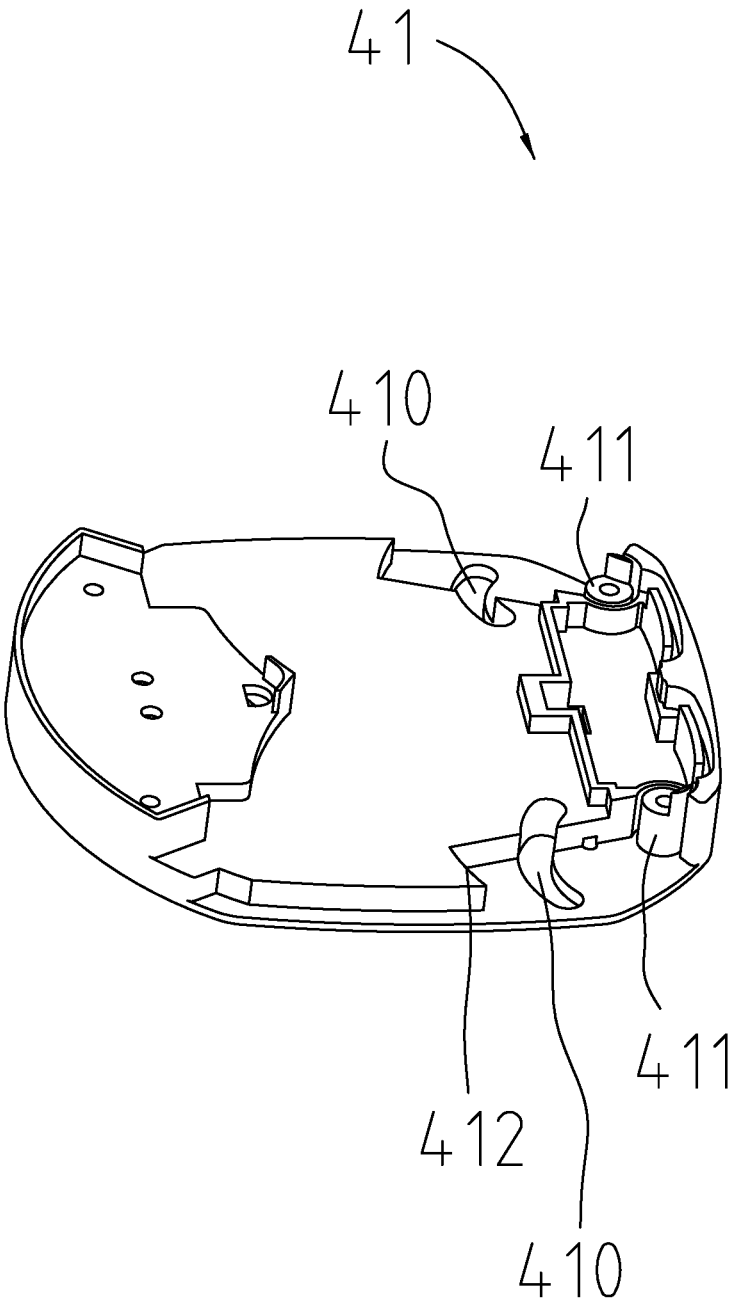
FIG. 7 is an inverted view of a first upper cover of FIG. 5.
Figure 8:
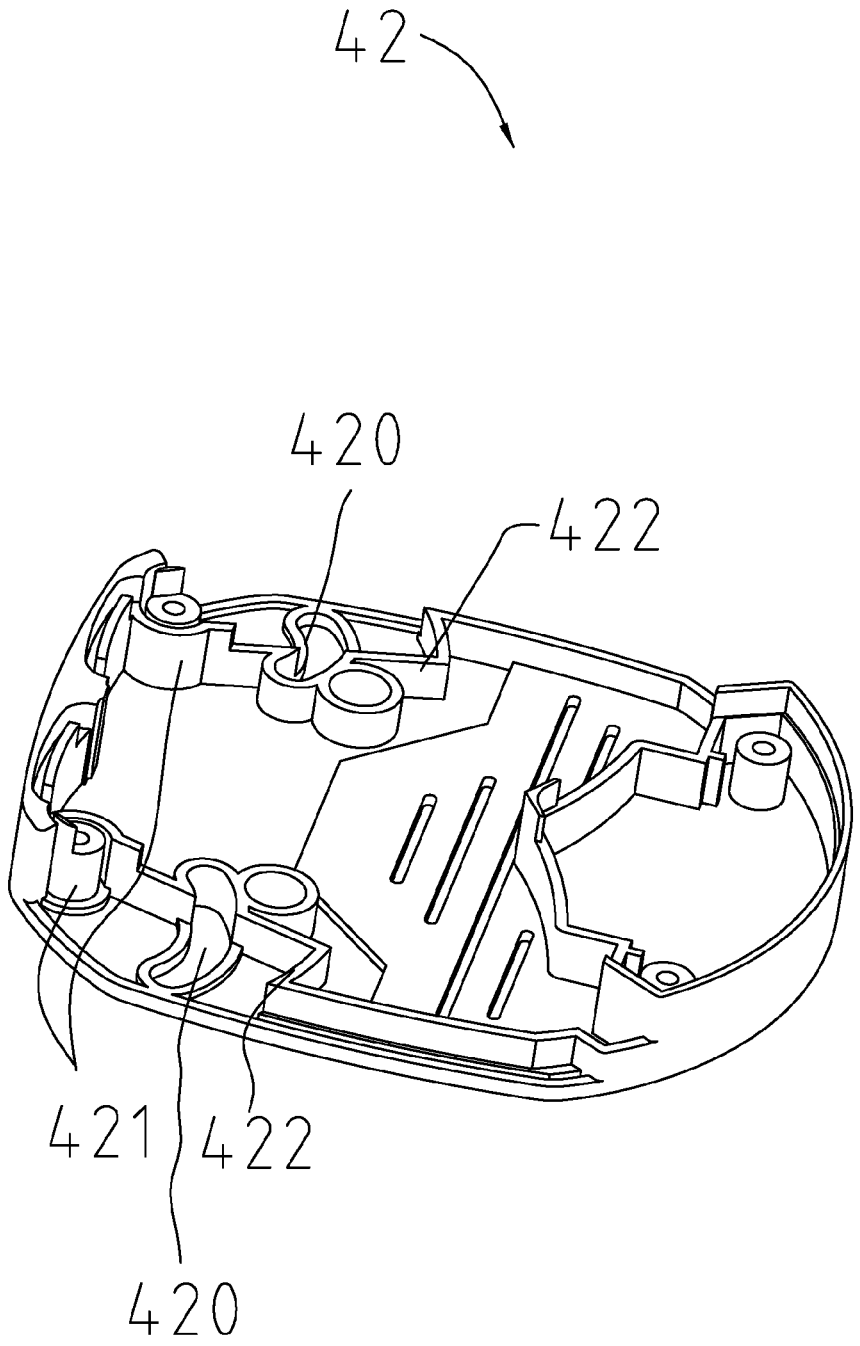
FIG. 8 is a perspective view of a first lower cover of FIG. 5.
Figure 9:
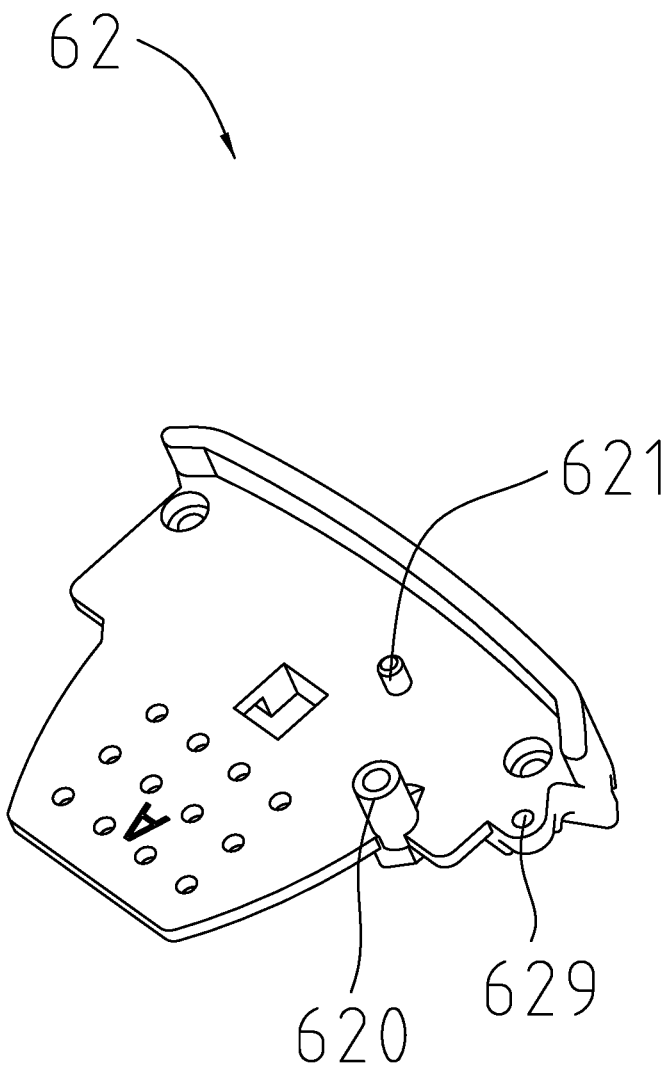
FIG. 9 is an inverted view of a second upper cover of FIG. 6.
Figure 10:
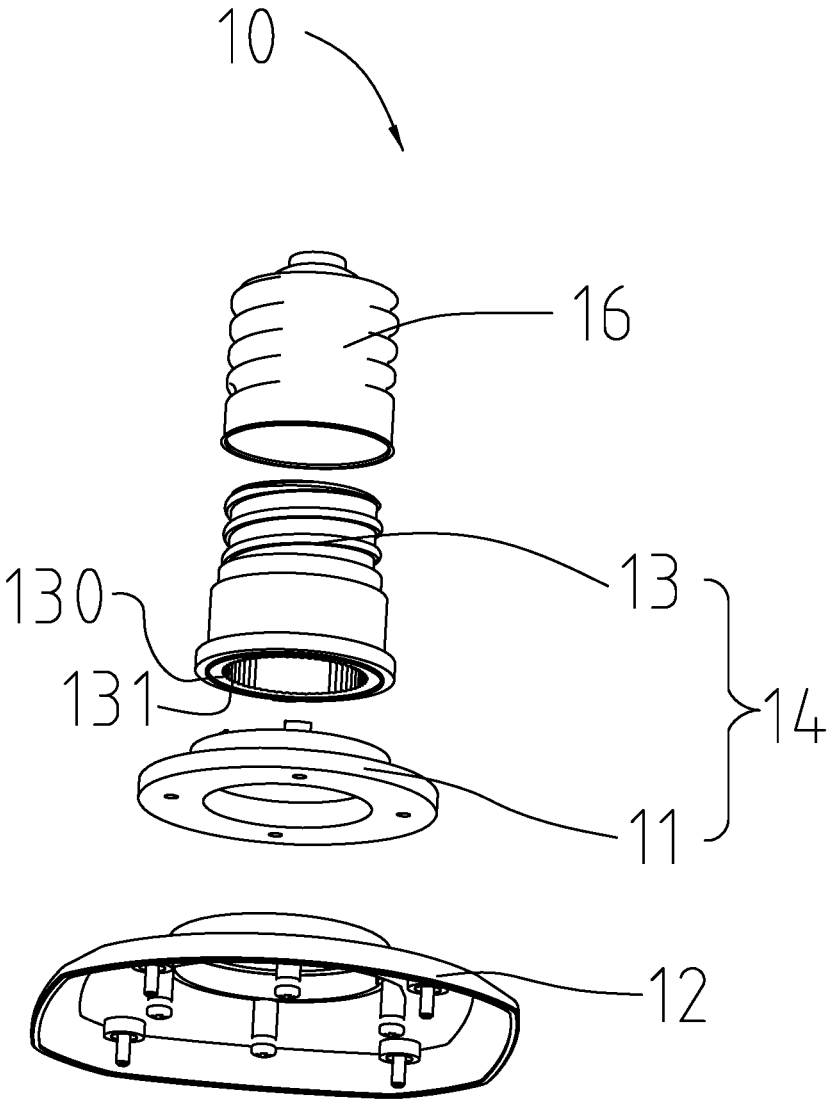
FIG. 10 is an exploded view of a lamp head of FIG. 1.
Figure 11:
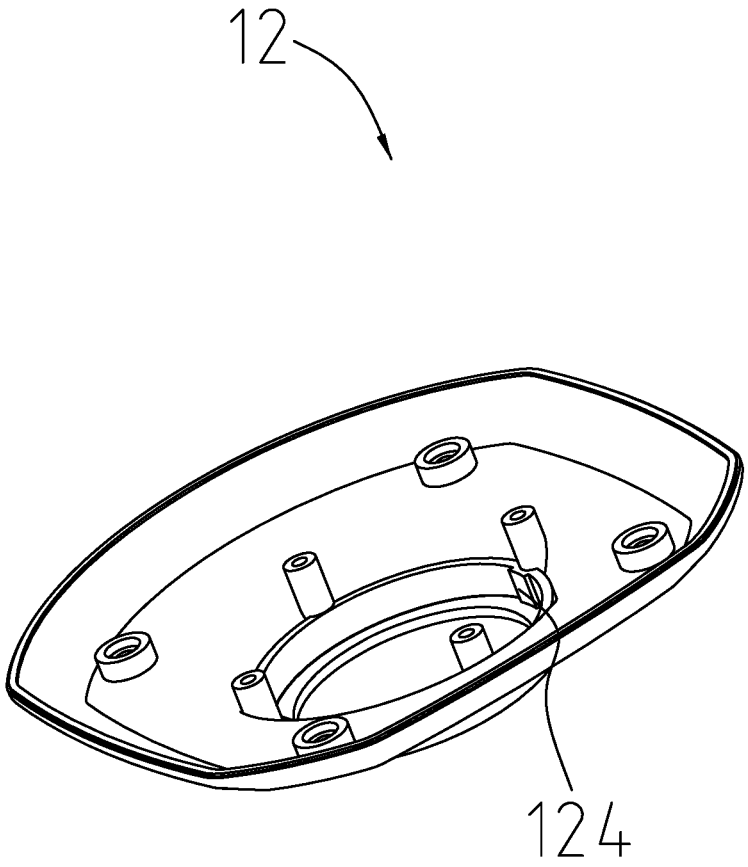
FIG. 11 is an inverted view of a head housing of FIG. 10.
Figure 12:
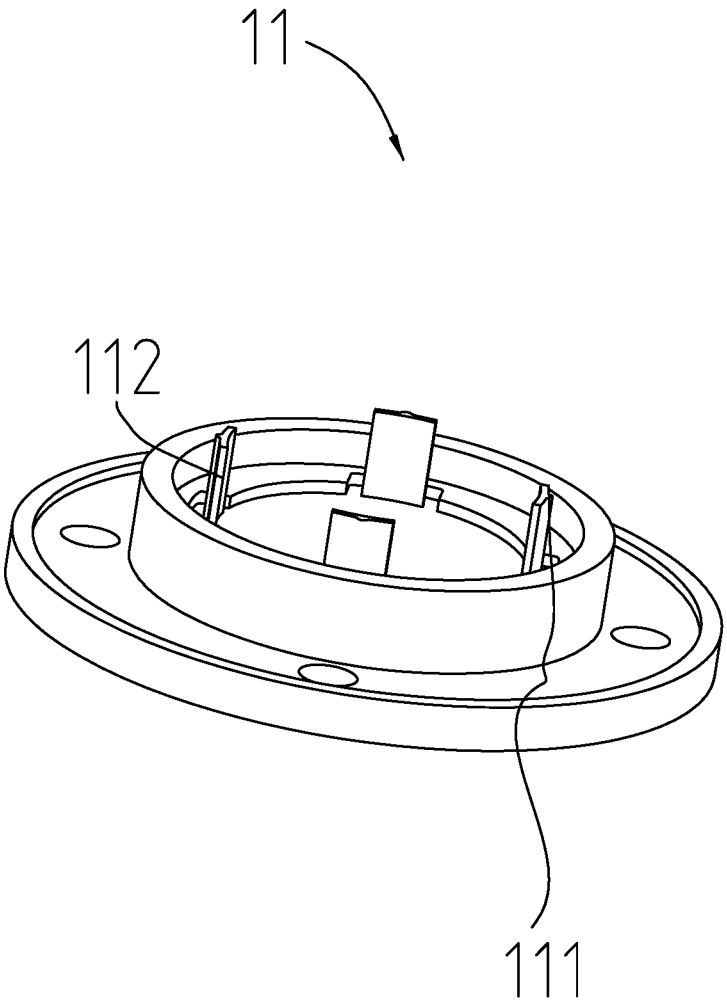
FIG. 12 is a perspective view of a second rotating portion of FIG. 10.
Figure 13:
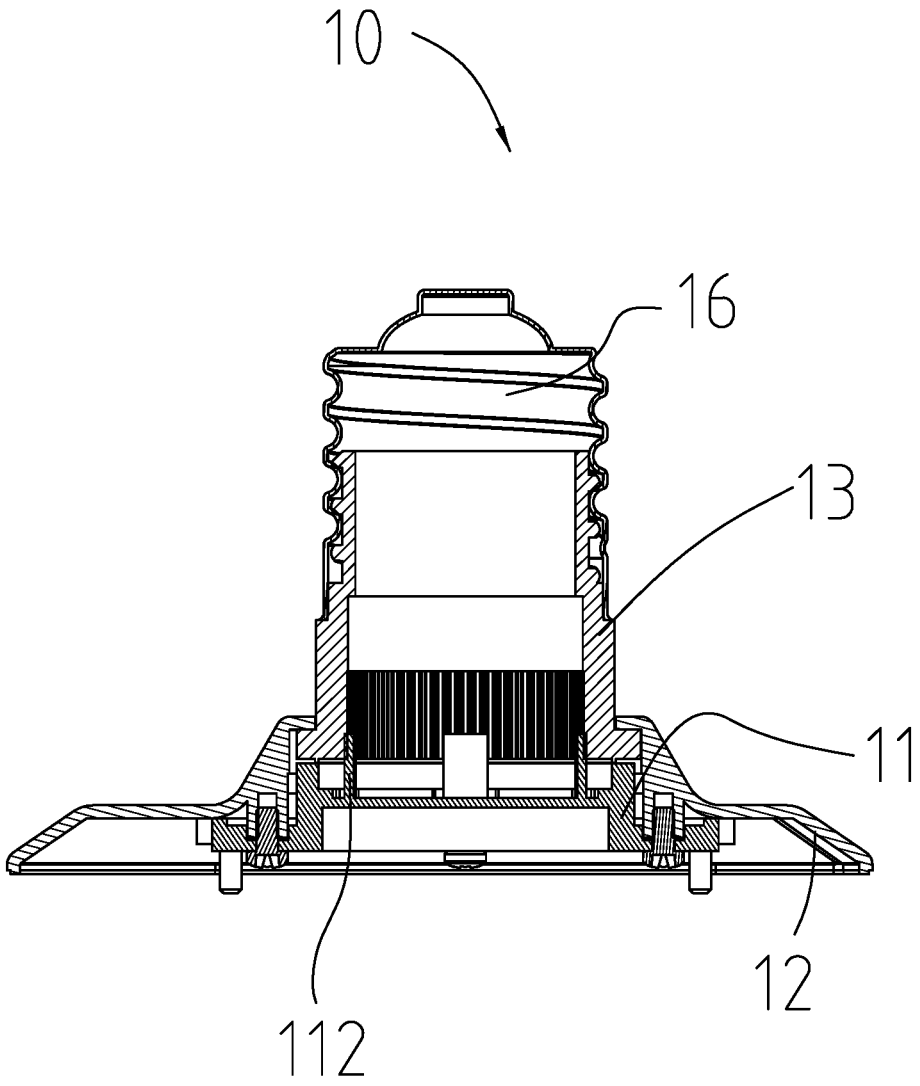
FIG. 13 is a cross-sectional assembled view of the lamp head of FIG. 10.
Figure 14:
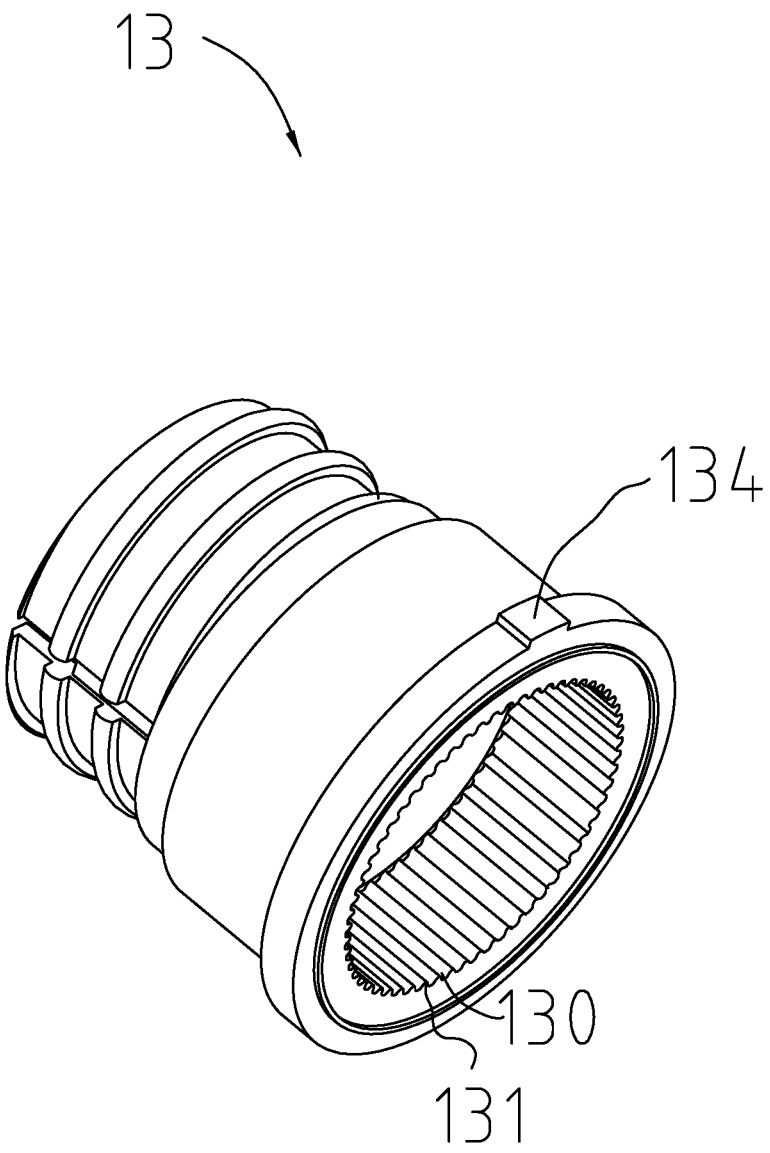
FIG. 14 is a perspective view of a first rotating portion of FIG. 10.

Referring to FIG. 5, FIG. 7, and FIG. 8, the first upper cover 41 includes a first limit portion 412, and the first lower cover 42 includes a second limit portion 422. When the LED lamp 100 is off, the second fixing post 611 is near to the first limit portion 412 and the fourth fixing post 621 is near to the second limit portion 422 to prevent each of the second main bodies 60 automatically rotates relative to the first main body 40 because of the elastic force of the first elastic element 43 and the second elastic element 44.

Referring to FIG. 5 and FIG. 6, the first upper cover 41 defines a pair of first sliding grooves 410, and each of the second upper coves 61 includes a first sliding post 610, wherein each of the first sliding posts 610 slides along each of the first sliding grooves 410.

Referring to FIG. 7 and FIG. 8, the first lower cover 42 defines a pair of second sliding grooves 420, and each of the second lower coves 62 includes a second sliding post 620, wherein each of the second sliding posts 620 slides along each of the second sliding grooves 420.

In one embodiment, radians of the first sliding grooves 410 and the second sliding grooves 420 are the same, so that an unfolding angle of each of the second main bodies 60 relative to the first main body 40 is the same. That is to say, the unfolding angle of each of the second main bodies 60 relative to the first main body 40 is the same as the radian of each of the first sliding grooves 410 and each of the second sliding grooves 420.

Referring to FIG. 5 and FIG. 6, each of the first sliding grooves 410 extends through two opposite surfaces of the first upper cover 41.

Referring to FIG. 2, FIG. 3, and FIG. 4, the first main body 40 includes a first lighting device 47, a power device 46, and a first heat sink 45 positioned between the first lighting device 47 and the power device 46. The first heat sink 45, the first lighting device 47, and the power device 46 are positioned between the first upper cover 41 and the first lower cover 42.

Each of the second main bodies 60 includes a second heat sink 65 and a second lighting device 67, and the second heat sink 65 and the second lighting device 67 are positioned between the second upper cover 61 and the second lower cover 62. When the LED lamp 100 is the open state, each of the second heat sink 65 relative to the first heat sink 45 is unfolded; when the LED lamp 100 is in the closed state, each of the second heat sink 65 relative to the first heat sink 45 is folded.

When the LED lamp 100 is the open state, each of the second main bodies is in an unfolded state and each of the second heat sink 65 is in an unfolded state, so that the first heat sink 45 and two second heat sinks 65 are not in a closed space, i.e., the first heat sink 45 and two second heat sinks 65 are in an open space, thereby heat dissipation space of the first heat sink 45 and two second heat sinks 65 is enlarged, heat generated by the first heat sink 45 and two second heat sinks 65 can be well spread around, heat dissipation effect of the LED lamp 100 relative to a convention LED lamp having a closed space is better, furthermore the service life of the LED lamp 100 is improved.

The first main body 40 includes a pair of first rotating shafts 48 and a pair of second rotating shaft 49. Each of the second upper cover 61 defines a first receiving hole 618, and each of the second lower cover 62 defines a second receiving hole 629. A first end of each of the first rotating shafts 48 is mounted to an upper end of the first heat sink 45, and a second end of each of the first rotating shafts 48 is received in a corresponding first receiving hole 618. A first end of each of the second rotating shafts 49 is mounted to a lower end of the first heat sink 45, and a second end of each of the second rotating shafts 49 is received in a corresponding second receiving hole 629. The second main bodies 60 rotate relative to the first main body 40 via the first rotating shafts 48 and the second rotating shaft 49.

In one embodiment, the first rotating shafts 48 and the second rotating shaft 49 are pins, and a structure of each of the first rotating shafts 48 is the same as a structure of each of the second rotating shafts 49. In another embodiment, the structure of each of the first rotating shafts 48 is different from the structure of each of the second rotating shafts 49.

In assemble, the first heat sink 45, the first lighting device 47, and the power device 46 are positioned between the first upper cover 41 and the first lower cover 42, and the first heat sink 45 is positioned between the first lighting device 47 and the power device 46, thereby integrating the first heat sink 45, the first lighting device 47, and the power device 46 into the first main body 40. The second heat sink 65 and the second lighting device 67 are positioned between the second upper cover 61 and the second lower cover 62, thereby integrating the second heat sink 65 and the second lighting device 67 into the second main body 60. Each of the second main bodies 60 is rotationally mounted to the first main body 40 via the first rotating shafts 48 and the second rotating shaft 49. Furthermore, one end of the first elastic element 43 is mounted to the first fixing post 411, another end of the first elastic element 43 is mounted to the second fixing post 611; one end of the second elastic element 44 is mounted to the third fixing post 421, another end of the second elastic element 44 is mounted to the fourth fixing post 621; each of the first sliding posts 610 slides along each of the first sliding grooves 410, and each of the second sliding posts 620 slides along each of the second sliding grooves 420. Thus, the first main body 40 and the second main bodies 60 are mounted to the LED lamp 100.

Referring to FIG. 10 to FIG. 14, the lamp head 10 includes a head housing 12, a rotating member 14, and a top member 16. The rotating member 14 is rotationally mounted to the head housing 12, and the top member 16 is mounted to the rotating member 14.

In one embodiment, a rotation range of the rotating member 14 relative to the head housing 12 is 0 degree to 350 degree to prevent cables of the LED lamp 100 from wring.

The rotating member 14 includes a first rotating portion 13 and a second rotating portion 11. The first rotating portion 13 includes a plurality of first protruding ribs 131, and the second rotating portion 11 includes a plurality of second protruding ribs 111. When the first rotating portion 13 rotates relative to the second rotating portion 11, the second protruding ribs 111 move among the first protruding ribs 131.

The second rotating portion 11 includes a plurality of cantilevers 112, and one second protruding rib 111 projects from each of the cantilevers 112. A first slot 130 is defined between two adjacent first protruding ribs 131, and each of the second protruding ribs 111 is received in a corresponding first slot 130 to position the first rotating portion 13 and the second rotating portion 11.

Because each of the second protruding ribs 111 projects from a corresponding cantilever 112, each of the second protruding ribs 111 has resilient, thereby motion of the second protruding ribs 111 relative to the first protruding ribs 131 is more easy.

In one embodiment, the first protruding ribs 131 and the first slots 130 are located around an inner wall of the first rotating portion 13, i.e., the first protruding ribs 131 and the first slots 130 are uniformly positioned around the inner wall of the first rotating portion 13 during a range of 360 degrees, so that the first rotating portion 13 and the second rotating portion 11 can be arbitrarily positioned within the range of 360 degrees.

The head housing 12 includes a first block 124, and the first rotating portion 13 includes a second block 134 together with the first block 124 to prevent the lamp head 10 from excessive rotation.

In one embodiment, a width of the first block 124 and the second block 134 decides a rotation range of the lamp head 10.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A light-emitting diode (LED) lamp, comprising:

a lamp head; and a lamp body mounted to the lamp head, the lamp body comprising:

a first main body comprising a first upper cover, a first lower cover, at least one first elastic element, and at least one second elastic element; and a pair of second main bodies positioned two sides of the first main body, each of the second main bodies rotationally mounted to the first main body and comprising a second upper cover, a second lower cover, wherein one end of the first elastic element is mounted to the first upper cover, another end of the first elastic element is mounted to the second upper cover, one end of the second elastic element is mounted to the first lower cover, another end of the second elastic element is mounted to the second lower cover;

wherein when the LED lamp is in an open state, the first elastic element and the second elastic element is in a free state, each of the second main bodies relative to the first main body is unfolded; when the LED lamp is in a closed state, the first elastic element and the second elastic element is in a compression state, each of the second main bodies relative to the first main body is folded.

2. The LED lamp of claim 1, wherein the first upper cover comprises a first fixing post, the second upper cover comprises a second fixing post, the one end of the first elastic element is mounted to the first fixing post, the another end of the first elastic element is mounted to the second fixing post.

3. The LED lamp of claim 1, wherein the first lower cover comprises a third fixing post, the second lower cover comprises a fourth fixing post, the one end of the second elastic element is mounted to the third fixing post, the another end of the second elastic element is mounted to the fourth fixing post.

4. The LED lamp of claim 1, wherein the first upper cover defines a pair of first sliding grooves, each of the second upper coves comprises a first sliding post, wherein each of the first sliding posts slides along each of the first sliding grooves.

5. The LED lamp of claim 4, wherein the first lower cover defines a pair of second sliding grooves, each of the second lower coves comprises a second sliding post, wherein each of the second sliding posts slides along each of the second sliding grooves.

6. The LED lamp of claim 1, wherein the first main body comprises a first lighting device, a power device, and a first heat sink positioned between the first lighting device and the power device, the first heat sink, the first lighting device, and the power device are positioned between the first upper cover and the first lower cover.

7. The LED lamp of claim 1, wherein each of the second main bodies comprises a second heat sink and a second lighting device, the second heat sink and the second lighting device are positioned between the second upper cover and the second lower cover, wherein when the LED lamp is the open state, each of the second heat sink relative to the first heat sink is unfolded; when the LED lamp is in the closed state, each of the second heat sink relative to the first heat sink is folded.

8. The LED lamp of claim 1, wherein the lamp head comprises a head housing and a rotating member, a rotation range of the rotating member relative to the head housing is 0 degree to 350 degree.

9. The LED lamp of claim 8, wherein the rotating member comprises a first rotating portion and a second rotating portion, the first rotating portion comprises a plurality of first protruding ribs, the second rotating portion comprises a plurality of second protruding ribs, wherein when the first rotating portion rotates relative to the second rotating portion, the second protruding ribs move among the first protruding ribs.

10. The LED lamp of claim 9, wherein the second rotating portion comprises a plurality of cantilevers, one second protruding rib projects from each of the cantilevers, wherein a first slot is defined between two adjacent first protruding ribs, and each of the second protruding ribs is received in a corresponding first slot to position the first rotating portion and the second rotating portion.

11. The LED lamp of claim 9, wherein the head housing comprises a first block, the first rotating portion comprises a second block together with the first block to prevent the lamp head from excessive rotation.

12. A light-emitting diode (LED) lamp, comprising:

a lamp body comprising a first main body and a pair of second main bodies rotationally mounted to the first main body; and a lamp head mounted to the lamp body, the lamp head comprising:

a head housing; and a rotating member rotating relative to the head housing, the rotating member comprising a first rotating portion and a second rotating portion, wherein the first rotating portion comprises a plurality of first protruding ribs, the second rotating portion comprises a plurality of second protruding ribs, wherein when the first rotating portion rotates relative to the second rotating portion, the second protruding ribs move among the first protruding ribs;

wherein when the LED lamp is in an open state, each of the second main bodies relative to the first main body is unfolded; when the LED lamp is in a closed state, each of the second main bodies relative to the first main body is folded.

13. The LED lamp of claim 12, wherein the second rotating portion comprises a plurality of cantilevers, one second protruding rib projects from each of the cantilevers, wherein a first slot is defined between two adjacent first protruding ribs, and each of the second protruding ribs is received in a corresponding first slot to position the first rotating portion and the second rotating portion.

14. The LED lamp of claim 13, wherein the head housing comprises a first block, the first rotating portion comprises a second block together with the first block to prevent the lamp head from excessive rotation.

15. The LED lamp of claim 12, wherein a rotation range of the rotating member relative to the head housing is 0 degree to 350 degree.

16. The LED lamp of claim 12, wherein the first main body comprises a first upper cover, a first lower cover, at least one first elastic element, and at least one second elastic element, each of the second main bodies comprises a second upper cover, a second lower cover, wherein one end of the first elastic element is mounted to the first upper cover, another end of the first elastic element is mounted to the second upper cover, one end of the second elastic element is mounted to the first lower cover, another end of the second elastic element is mounted to the second lower cover.

17. The LED lamp of claim 16, wherein when the LED lamp is in the open state, the first elastic element and the second elastic element is in a free state; when the LED lamp is in the closed state, the first elastic element and the second elastic element is in a compression state.

18. The LED lamp of claim 16, wherein the first upper cover defines a pair of first sliding grooves, each of the second upper coves comprises a first sliding post, wherein each of the first sliding posts slides along each of the first sliding grooves, and wherein the first lower cover defines a pair of second sliding grooves, each of the second lower coves comprises a second sliding post, wherein each of the second sliding posts slides along each of the second sliding grooves.

19. The LED lamp of claim 16, wherein the first main body comprises a first lighting device, a power device, and a first heat sink positioned between the first lighting device and the power device, the first heat sink, the first lighting device and the power device are positioned between the first upper cover and the first lower cover.

20. The LED lamp of claim 19, wherein each of the second main bodies comprises a second heat sink and a second lighting device, the second heat sink and the second lighting device are positioned between the second upper cover and the second lower cover, wherein when the LED lamp is the open state, each of the second heat sink relative to the first heat sink is unfolded; when the LED lamp is in the closed state, each of the second heat sink relative to the first heat sink is folded.

* * * * *